US005680941A

United States Patent [19]

Smith

[11] Patent Number: 5,680,941

[45] Date of Patent: Oct. 28, 1997

[54] WRAP-AROUND EXTERNALLY SHELVED DISPLAY STAND

[75] Inventor: Michael J. Smith, Orangeburg, N.Y.

[73] Assignee: Arrow Art Finishers, Inc., Bronx, N.Y.

[21] Appl. No.: 693,980

[22] Filed: Aug. 8, 1996

[51] Int. Cl.[6] ..... A47F 5/00

[52] U.S. Cl. ..... 211/133

[58] Field of Search ..... 211/133, 132, 211/196, 186, 187, 73; 248/174

[56] References Cited

U.S. PATENT DOCUMENTS

| | | | |
|---|---|---|---|
| 4,262,439 | 4/1981 | Dinan et al. | 211/187 X |
| 4,289,245 | 9/1981 | Hasulak | 248/174 X |
| 4,678,089 | 7/1987 | Lang | 211/133 |
| 4,974,734 | 12/1990 | Merl | 211/133 X |
| 5,000,329 | 3/1991 | Luberto | 211/133 X |
| 5,485,934 | 1/1996 | Holztrager | 211/13 X |
| 5,564,578 | 10/1996 | Smith | 211/133 |

*Primary Examiner*—Alvin C. Chin-Shue
*Assistant Examiner*—Sarah L. Purol
*Attorney, Agent, or Firm*—Kirschstein, et al.

[57] ABSTRACT

A display stand includes a central column of a tubular configuration that assumes an upright orientation in a use condition of the display stand and includes number of vertically spaced slot rows each including a plurality of discrete, circumferentially distributed slots, and a corresponding number of support elements of shelf-like configurations separate from the central column. The support elements include respective mounting portions that extend through the slots of the respectively associated ones of the slot rows into the interior of the tubular central column. The support elements extend substantially horizontally in the use condition. When the central column is rectangular, both the slots and the mounting portions extend across the corners of the columns. The mounting portions may be lobate and neighboring ones of them may jointly extend into the associated slots in an overlapping relationship with respect to one another.

9 Claims, 5 Drawing Sheets

WRAP-AROUND EXTERNALLY SHELVED DISPLAY STAND

BACKGROUND OF THE INVENTION

1. Field of the Invention

The present invention relates to display stands in general, and more particularly to a display stand capable of prominently displaying the items being offered.

2. Description of the Related Art

There are already known various constructions of display stands, among them such that include a plurality of shelves each for supporting one or more items being offered for sale (in retail establishments or the like) or for the taking (in tourist or travel offices, at trade fairs, or the like). Such display stands are ordinarily constructed as permanent structures of wood, plastic or other relatively strong materials.

However, a more recent trend is for at least some of the goods or items to be displayed on "temporary" display stands that may be put into store or supermarket aisles to present items that are to be highlighted that day, that week, or whatever. Because of being made of less sturdy (even though still quite deformation-resistant) material, such as corrugated board or cardboard, such structures are typically enclosed on three sides, leaving just one side open for the observation of the items being offered. This, of course, is less than advantageous because it could result in a situation where a prospective purchaser will not pick up the item merely because of not noticing it due to approaching the display stand from the "wrong" direction. This is highly undesirable.

OBJECTS OF THE INVENTION

Accordingly, it is a general object of the present invention to avoid the disadvantages of the prior art.

More particularly, it is an object of the present invention to provide a display stand that does not possess the drawbacks of the known display stands of the aforementioned type.

Still another object of the present invention is to devise a display stand of the type here under consideration which is capable of holding the items on display in a virtually unimpeded view condition.

It is yet another object of the present invention to design the above display stand in such a manner as to take up a minimum amount of space when not in use.

A still further object of the present invention is to develop a display stand of the above type which can be easily assembled from its component parts and yet will reliably stay in its assembled condition even as the weight of the items resting on it changes or shifts.

A concomitant object of the present invention is so to construct the display stand of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a display stand that includes as its constituent components a central column of a tubular configuration that assumes an upright orientation in a use condition of the display stand and includes a number of vertically spaced slot rows each including a plurality of discrete, circumferentially distributed slots, and a corresponding number of support elements of shelf-like configurations separate from the central column, including respective mounting portions extending through the slots of the respectively associated ones of the slot rows into the interior of the tubular central column, and extending substantially horizontally in the use condition.

It is especially advantageous when the tubular central column as well as each of the support elements extends along a substantially rectangular course and hence includes respective corners, and when the slots of all of the slot rows extend across the corners of the central column and the mounting portions span the corners of the support elements.

According to a particularly novel aspect of the present invention, the mounting portions have lobate configurations. It is further advantageous when the central column and each of the support elements has a multitude of sides meeting at the respective corners, and each of the support elements has two of the mounting portions located at respective ends thereof, with the neighboring mounting portions of the respective adjacent ones of the sides jointly extending through the respective ones of the slots in a juxtaposed relationship with respect to one another.

In accordance with another novel facet of the invention, each of the sides of each of the support elements has additional portions hingedly connected to the mounting portion and to one another and folded together in the use condition in such a manner as to form an item-retaining rim on the respective support element. In this context, it is further advantageous when the lowermost one of the support elements as considered in the use condition is inverted relative to the remaining ones of the support elements such that the rim thereof extends downwardly into contact with the ground to provide an extended base for the display stand.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
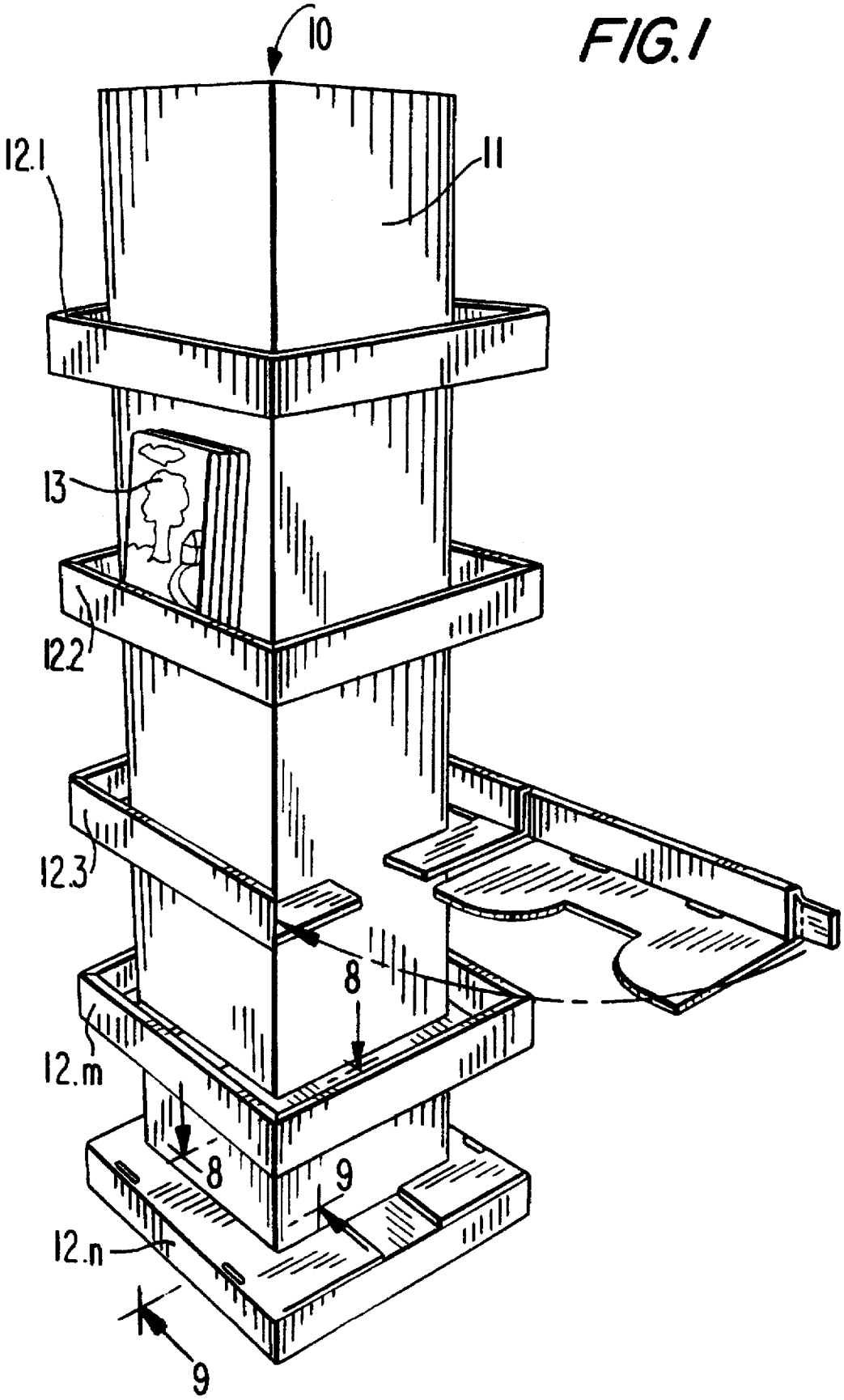
FIG. 1 is a perspective view of a display stand of the present invention including a central support column and a plurality of separate support shelves, in its almost fully assembled condition of use.

Referring now to the drawing in detail, and first to FIG. 1 thereof, it may be seen that the reference numeral 10 has been used therein to identify a display stand of the present invention in its entirety. The display stand 10 includes as its main or constituent components a central support column 11 and a plurality of support elements 12.1 to **12.*n*, wherein n is any positive integral number within reason (in the illustrated example five. The support elements 12.1 to 12.*n* include a number of support shelves 12.1 to 12.*m* (wherein m=n−1), and a base 12.*n*. Except as will be noted later, the construction of the support elements 12.1 to 12.*n* and their arrangement with respect to and cooperation with the central support column 11** are substantially identical, so that they are fully interchangeable.

The support elements 12.1 to **12.*n* are connected to the central support column 11 in a manner that will be explained shortly. It is, however, to be mentioned first that the support shelves 12.1 to 12.*m* (and possibly also the base 12.*n*) are intended and constructed for use for supporting and/or holding various goods and items, such as those indicated at 13, in positions relative to prospective purchasers passing by the display stand 10 as to show such items 13 to their best advantage with the ultimate goal of making the patrons of a retail establishment, or other customers, clients, frequenters or visitors of the premises where the display stand 10 is located, to notice such items 13 and be attracted to them, whether such items 13** are actually for sale (as they would be, e.g., in a retail store) or are distributed gratis (as, for instance, advertising brochures for various establishments or attractions would be in a travel office or the like).

It will be appreciated that the display stand 10 can be put to use for displaying a wide variety of items 13 of different sizes and that, as a consequence, the number of the support shelves 12.1 to **12.*m* may be different for different ones of such applications, being dependent, for instance, on the size of the items 13 to be displayed. In this respect, like in others (such as color, the presence of any printed matter on the external surfaces of the display stand 10, and the like) the display stand 10 can be tailored to the needs of the ultimate user. However, such customization entails additional expense on the part of the manufacturer and hence additional cost for the ultimate user, so that it is currently contemplated to be used quite rarely, and for sufficiently large orders only. For all other purposes, it is presently thought to be sufficient to make the display stand 10 reasonably attractive in appearance and versatile enough to be usable with a vast selection of articles of merchandise that may come into consideration for being displayed on the display stand 10 as the particular items 13**.

Figure 2:
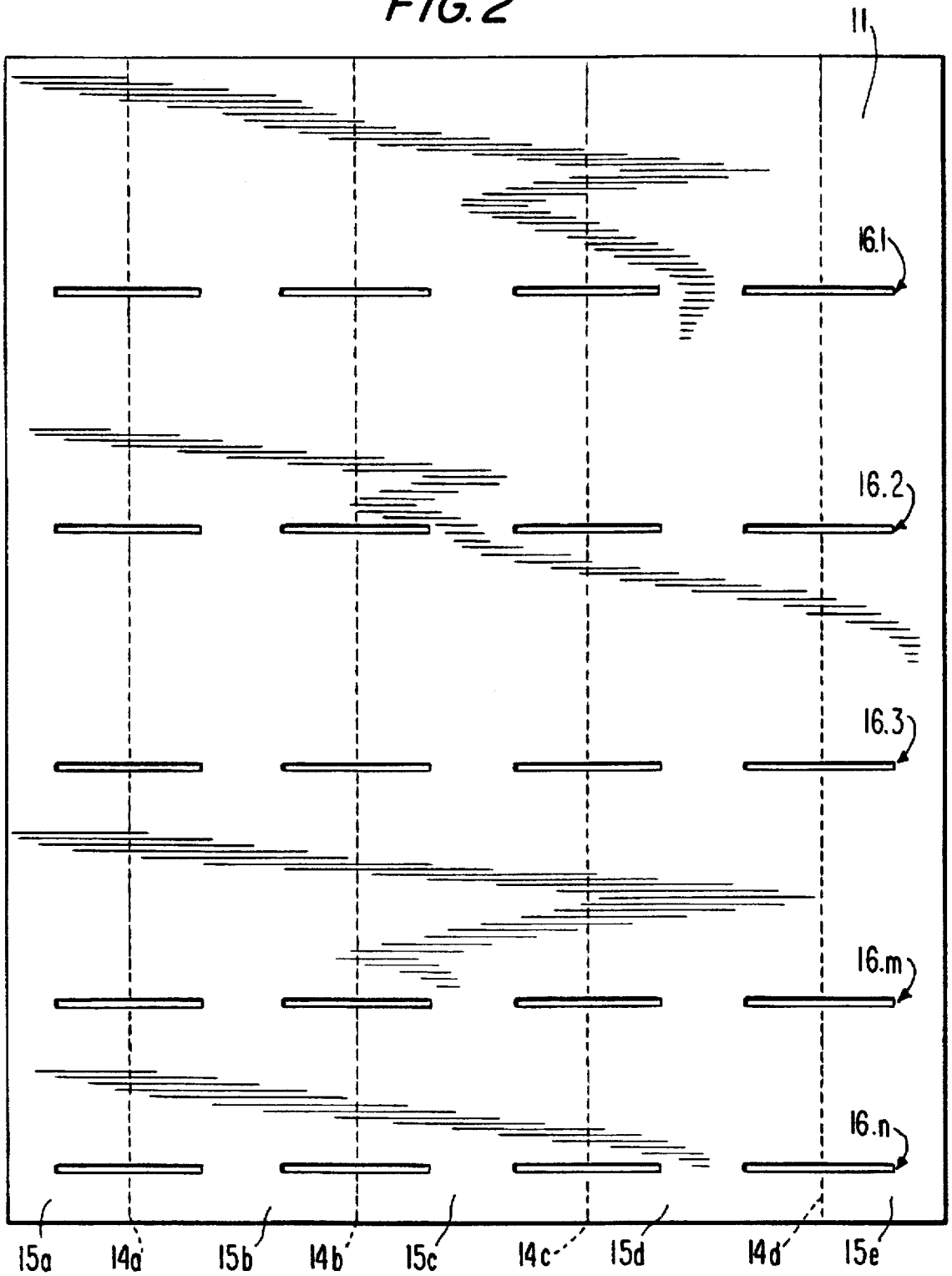
FIG. 2 is a developed view of only the support column of the display stand of FIG. 1.

While the central column 11 is shown in FIG. 1 of the drawing in its erect final form in which it is to be used, in FIG. 2 it is in its original, as-made precursor state in which it is developed into the plane of the drawing. It may be seen that in this condition the central column precursor 11 has a generally or exactly rectangular outline. As is usual in this field of human endeavor, the precursor 11 may be made of corrugated board, cardboard or a similar relatively sturdy material, especially such that exhibits a relatively nice-looking "skin" on at least one of its major surfaces (that which is to face outwardly in the finished stand 10) but, inasmuch as the additional expense involved is not all that great, on both.

The precursor 11 is provided with respective weakened portions or creases **14*a* to 14*d* that subdivide the precursor 11 into respective panels 15*a* to 15*e* and act as respective hinges about which the respective adjacent ones of the panels 15*a* to 15*e* can be preferentially angularly displaced or pivoted relative to one another to form the essentially box-shaped configuration of the central column 11 in its final form as it appears in FIG. 1 of the drawing. It should be noted that in the illustrated embodiment the panels 15*a* and 15*e* are about a half as wide as the remaining panels 15*b* to 15*d* so that, when the aforementioned pivoting is completed, they in essence complement each other into a panel of about the same width as the opposite panel 15*c*. It should go without saying, however, that the panels 15*b* to 15*d* and the composite panel 15*a*, 15*e*, need not all be of the same width if, for some reason, a cross-sectional configuration differing from the illustrated square or rectangular one is preferred for the column 11 and correspondingly for the associated shelves 12.1 to 12.*n*. Of course, if it is desired for one reason or another for the display stand 10 to have more or less than the illustrated four sides, the number of panels 15*a* to 15*e*** can be increased or reduced accordingly.

It is also to be mentioned that the panels **15*a* and 15*e*, instead of abutting one another in the full complementation situation assumed above, could also overlap one another to a greater or lesser extent, or fall short of meeting each other, in the erected central column 11, especially if the appearance of the side constituted by such panels 15*a* and 15*e* is of little or no concern, possibly because it will be hidden from view when the display stand 10 is in use. Moreover, even though this expedient is not shown because it is conventionally used in the field of making box-like structures from cardboard material or the like, the panels 15*a* and 15*e* could be secured to one another in one way or another (by staples, a layer or dabs of adhesive, an adhesive tape extending over the interface between the panels 15*a* and 15*e***, or the like) after the completion of the above-mentioned pivoting.

It should be realized that in the final form of the display stand 10 shown in FIG. 1 of the drawing, the crease regions **14*a* to 14*d* constitute the corners of the central column 11, and that, consequently, the slots of the slot rows 16.1 to 16.*n* which, as shown in FIG. 2 of the drawing, extend across the respective creases 14*a* to 14*d* to substantially the same distances therefrom, extend around the corners of the erected central column 11. Of course, the provision of the two complementary half-panels 15*a* and 15*e* instead of a single panel of about the same width as its opposite counterpart 15*c* not only removes the seam or interface between the originally unconnected marginal regions of the precursor 11 from the corner region of the erected central column 11 where it could form a gaping gap, but also provides for all of the slots of the slot rows 16.1 to 16.*n* to be located at a distance from such marginal regions, thus safeguarding their integrity and especially their resistance to widening when subjected to forces, especially those resulting from the weight of the items 13 resting on the shelves 13.1 to 13.*n*, by making all of them closed (i.e. fully surrounded by the material of the precursor 11** ) at both of their ends.

As shown in FIG. 1 of the drawing especially with respect to the support shelf 12.3, the support elements 12.1 to **12.*n* are wrapped around the central column 11 and connected to it in the final form of the display stand 10. This support element connection is accomplished under the utilization of the slot rows 16.1 to 16.*n* in a manner that will be readily understood once it is appreciated what the structure of the support elements 12.1 to 12.*n* is. To help in this regard, attention is now being directed to FIG. 3 of the drawing which shows, as an example representative of all of the support elements 12.1 to 12.*n*, the aforementioned support shelf 12.3 in its developed, substantially planar, as-fabricated precursor condition. Similarly to the central column precursor 11, the chosen shelf precursor 12.3, like each other of the remaining ones of the support element precursors 12.1 to 12.*n*, is subdivided by respective crease lines 17*a* to 17*c* into respective sections 18*a* to 18*d*. These support element sections 18*a* to 18*d* correspond to respective associated ones of the central column panels 15*a* to 15*e*** and hence are substantially conformingly dimensioned with respect thereto, in the order indicated but not necessarily in a one-to-one correspondence of their reference numeral suffixes.

Each of the aforementioned crease lines **17*a* to 17*c* is adjoined at each of its ends by respective open-ended slits 19*a* to 19*c* and 21*a* to 21*c* that form substantially straight-line continuations of the associated crease lines 17*a* to 17*c*. The slits 19*a* to 19*c* separate respective "inner horizontal" zones 20*a* to 20*d* from one another, while the slits 21*a* to 21*c* perform the same function with respect to "inner vertical" zones 22*a* to 22*d*. At this juncture, it is to be mentioned that whenever reference is being had herein to orientation, directions, or relative locations, it is with respect to the position of the display stand 10 in its assembled condition of use depicted, by and large, in FIG. 1 of the drawing. The inner horizontal zones 20*a* to 20*d* include respective pairs of lobes that are identified, as parts of the zones 20*a* to 20*d***, by the same reference numerals but supplemented by a prime, on the one hand, and by a double prime, on the other hand.

A single crease line 23 and a double crease line 24 extending parallel to one another and at a predetermined distance from one another longitudinally of the strip-shaped support element precursor 12.3 simultaneously separate the respective zones **20*a* to 20*d* and 22*a* to 22*d* from associated centrally located "outer vertical" zones 25*a* to 25*d* that are also delimited by the crease lines 17*a* to 17*c*, and connect such zones 20*a* to 20*d*, 22*a* to 22*d* and 25*a* to 25*d* with one another for pivoting relative to each other, in the order of their reference numeral suffixes. The presence of the crease lines 17*a* to 17*c*, 23, and 24, and of the slits 19*a* to 1% and 21*a* to 21*c* renders it possible to fold the representative support element 12.3 from its precursor state of FIG. 3 into its final state revealed in FIG. 4**.

Figure 3:
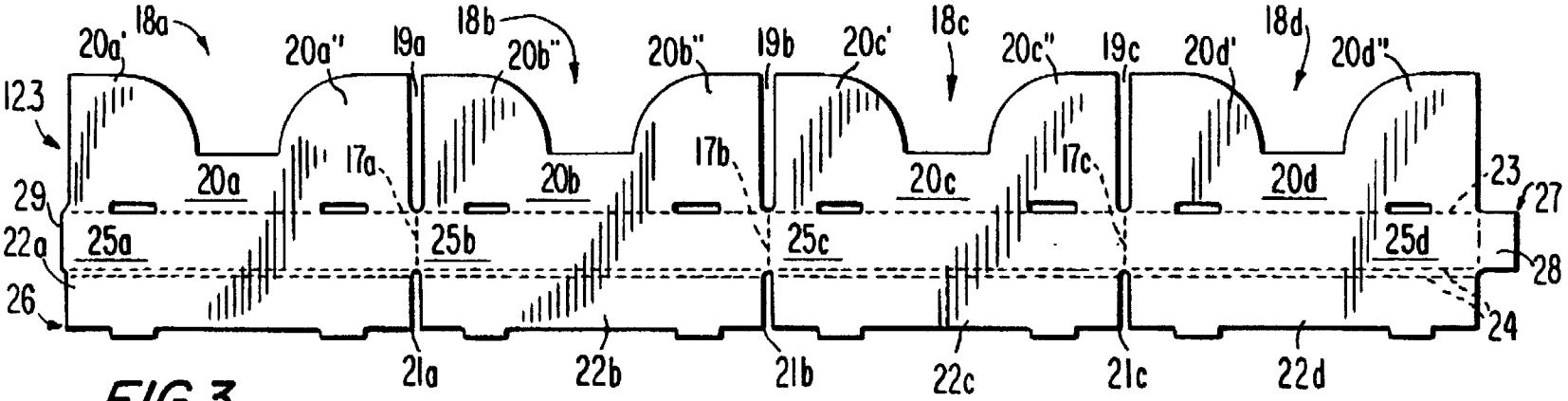
FIG. 3 another developed view, but this time of one of the support shelves.

It should also be noted that each the sections **18*a* to 18*d* are provided with a row 26 of tabs projecting beyond the remainder of the course of a bottom edge of the precursor 12.3 as considered in FIG. 3 of the drawing, and with a corresponding row 27 of slot-shaped openings arranged within or close to the crease line 23. Each of the rows 26 and 27 includes at least one but preferably a plurality of (as shown, two symmetrically arranged) the aforementioned tabs and slot-shaped openings arranged at corresponding locations of the sections 18*a* to 18*d* such that the tabs of the row 27 are received in the openings of the row 26 in the folded condition of the support element 12.3 illustrated in FIG. 4 and retain the respective zones 20*a* to 20*d*, 22*a* to 22*d* and 25*a* to 25*d*** in their desired positions relative to one another.

Figure 4:
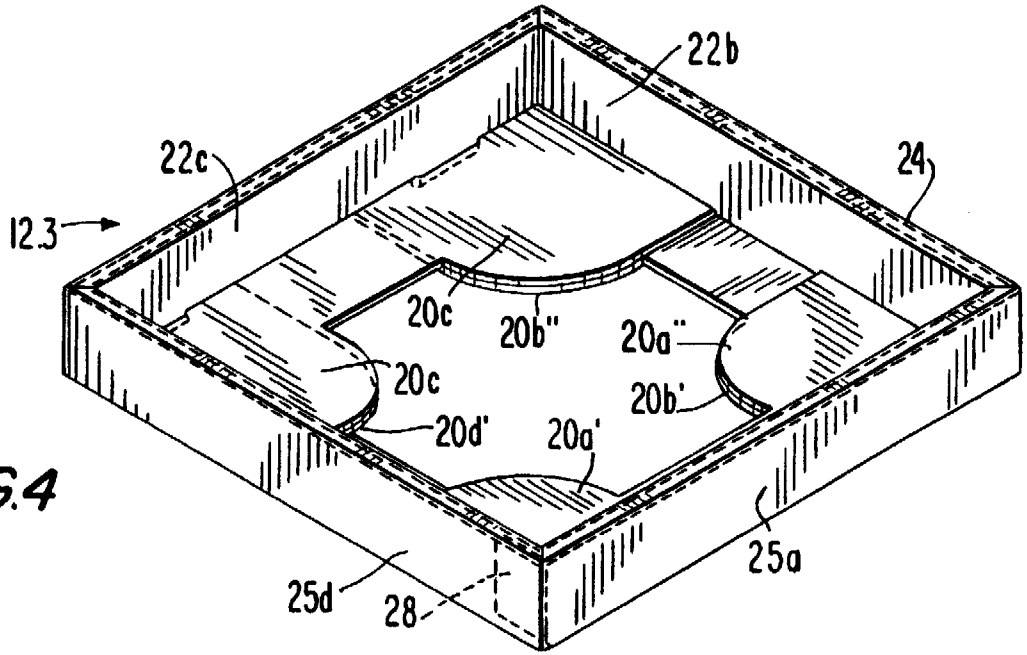
FIG. 4 is a perspective view of the support shelf of FIG. 3 in its final condition that it assumes when used on the support column, but taken in the absence of the latter.

In this respect, it should be noted that in the folded condition of FIG. 4 the lobes **20*a*' to 20*d*' and 20*a*" to 20*d*" are juxtaposed with one another in such a manner that those of the respective adjacent ones of the sections 20*a* to 20*d* that are denoted with the primes either overlie or underlie those with double primes. This results in a reinforcement of the support element structure 12.3 at regions where it matters the most, i.e. at the corner regions at which the element 12.3 is mounted on the central column 11 as will become even clearer later. It is also to be pointed out that in the folded condition of the support element 12.3 the respective associated zones 22*a* to 22*d* and 25*a* to 25*d* are folded around the double crease line 24 into juxtaposition with one another, thus providing a reinforced (doubled) construction for a rim of the representative support element 12.3** as well.

Moreover, it may be noticed that the end central zone **25*d* is provided with an extension 28 which, in the folded condition depicted in FIG. 4 extends across the gap that would otherwise exist between the adjacent central zones 25*d* and 25*a* and thus make such gap, which could otherwise significantly detract from the overall appearance of the display stand 10, effectively disappear. The central zone 25*a* may also be provided at its corresponding region with a (much smaller) tab 29, but this is not crucial but rather just an aid in disassembling the folded support element 12.3** by providing a prominence or protuberance that can be easily engaged during such process.

Figure 5:
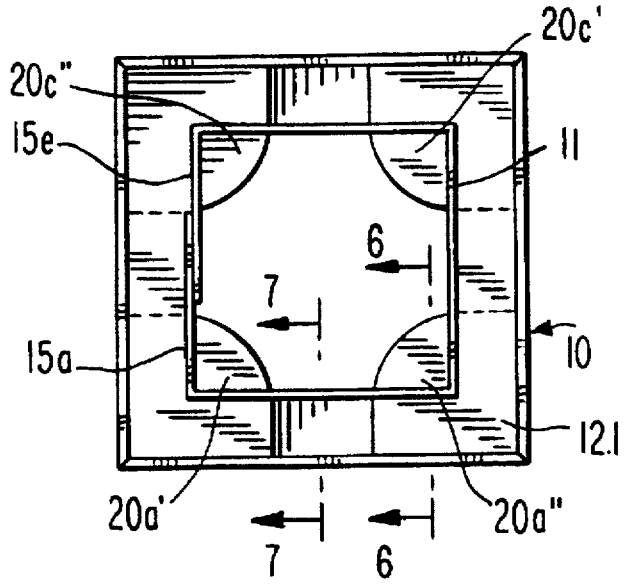
FIG. 5 is a top plan view of the display stand of FIG. 1 showing the support shelf of FIG. 4 in its final condition, as assembled with the support column of FIG. 2 in its final state.

Turning now to FIG. 5 of the drawing, it may be seen there that, when the support element 12.1 in its folded condition of FIG. 4 is assembled with the central column 11, the doubled-up lobes **20*a*' to 20*d*' and 20*a*" to 20*d*" project (through the associated slots of the slot row 16.1) from the exterior of the central column 11, where the remainder of the support element 12.1 is located, into the interior of the central column 11. What matters in this respect is not only that the lobes 20*a*' to 20*d*" extend through the slots of the row 16.1 and hence are supported on the surfaces bounding such slots, but also that they are doubled up, thus effectively enhancing the support action existing at the respective affected corner regions of the support element 12.1. It may also be seen in FIG. 5 that the half-panels 15*a* and 15*e* overlap one another in this currently preferred embodiment of the display stand 10**, thus leaving no discernible gap in between them.

Figure 6:
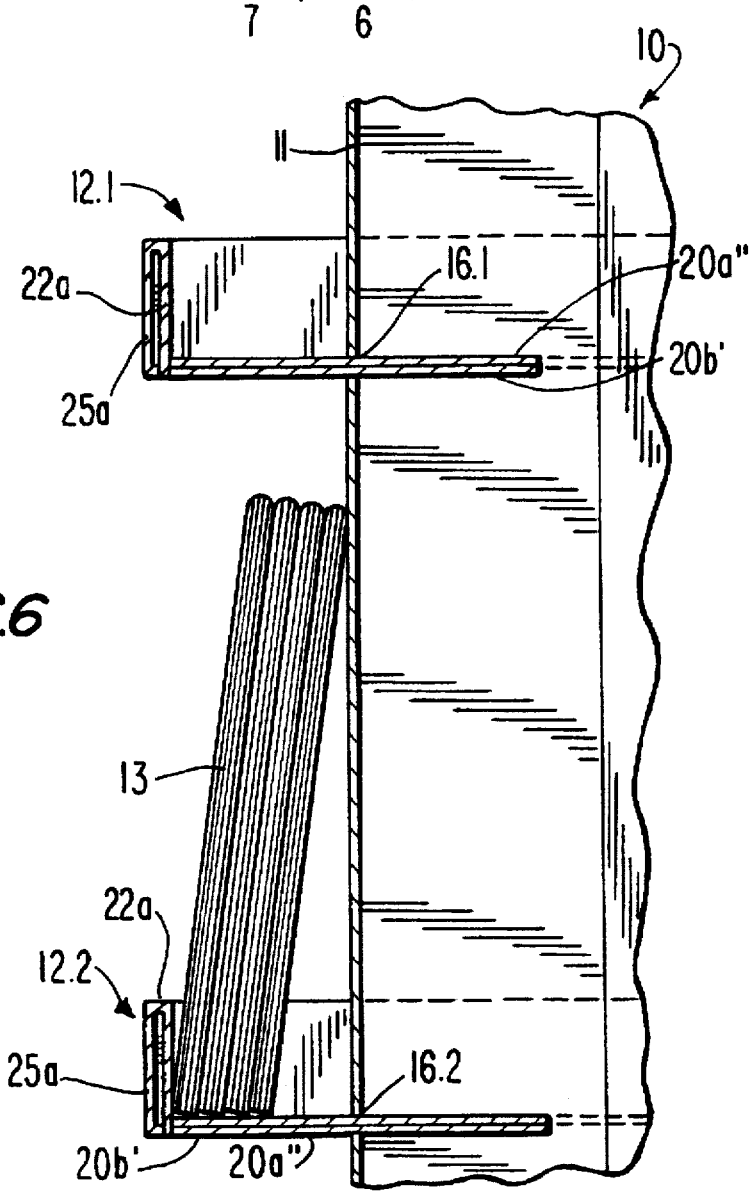
FIG. 6 is a vertical sectional view taken on line 6—6 of, and on a scale enlarged with respect to, FIG. 5.

FIG. 6 of the drawing shows in some more detail how the doubled-up lobes **20*a*" and 20*b*' of the support elements 12.1 and 12.2 extend substantially horizontally through the associated slots of the rows 16.1 and 16.2, and that the doubled-up outer and inner zones 22*a* and 25*a* extend substantially vertically to constitute the aforementioned rims of the support elements 12.1 and 12.2 against which the items 13 may brace themselves to prevent them from sliding off of the respective support shelves 12.1 to 12.*m***.

Figure 7:
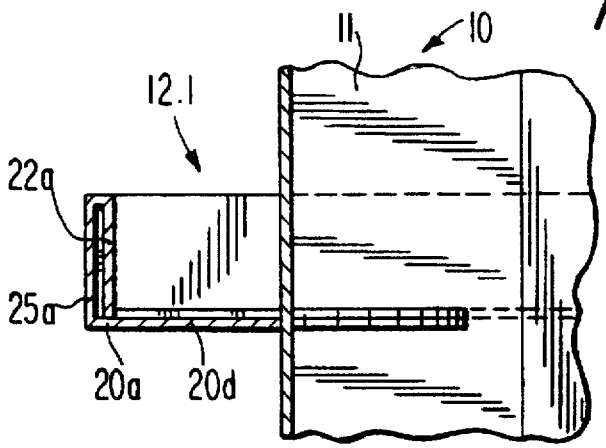
FIG. 7 is another relatively enlarged vertical sectional view, but this time taken on line 7—7 of FIG. 5.
Figure 8:
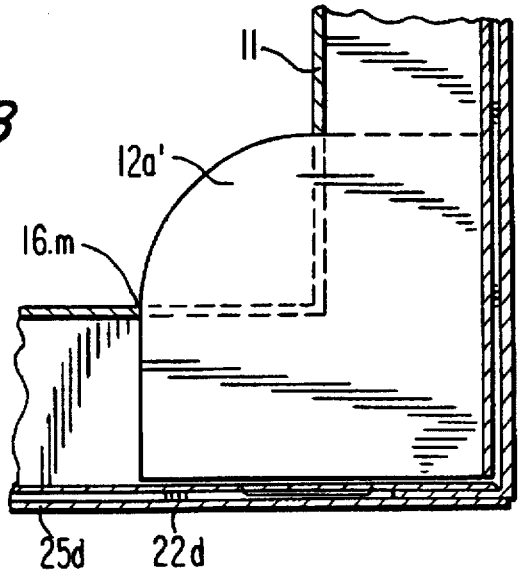
FIG. 8 is a horizontal sectional view taken along line 8—8 of FIG. 1 through a fragment of one of the support shelves.

FIG. 7 reveals that, in between the lobes such as **12*a*' and 12*a*", the section such as 20*a* is not doubled up and terminates just short of the outer periphery of the central column 11. Obviously, there is not a slot of the respective one of the rows 16.1 to 16.*n* present at this location either, not only because it is unnecessary but also, and predominantly, because it would jeopardize the structural integrity and hence the supporting function of the central column 11. FIG. 8, on the other hand, shows from a different angle how the lobes extend through the respective slot of the slot row 16.*m***.

Figure 9:
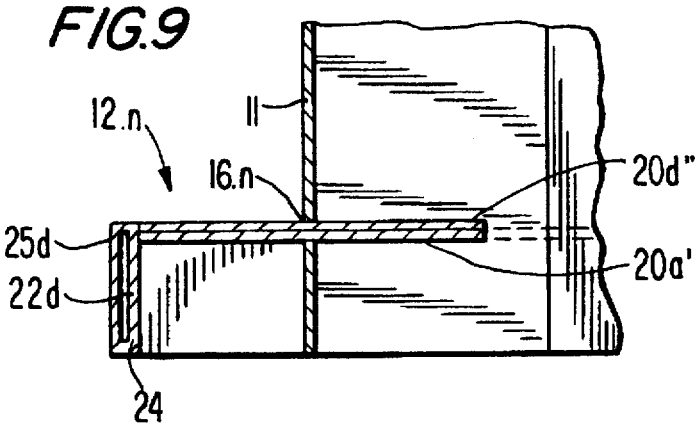
FIG. 9 is still another relatively enlarged vertical sectional view, now taken on line 9—9 of FIG. 1.

As a comparison of FIGS. 1, 2 and 9 will reveal, the support element **12.*n*, albeit constructed in the same manner as the remaining support elements 12.1 to 12.*n*, is not being used the same way; rather, it is being used in an inverted ("upside-down") position to constitute not a rimmed shelf but an extended base for the display stand 10. To this end, the slots of the row 16.*n* are spaced from the lower end face of the support column 11 by a distance substantially corresponding to (or even slightly smaller than) the width (i.e. the vertical dimension) of the rim constituted by the zones 22*a* to 22*d* and 25*a* to 25*d* This means that the structure or display stand 10 rests at least partially on the crease region 24 of the support element 12.*m*, thus making toppling over of the display stand 10 less likely than it would be in the absence of such an expedient. It may be seen in FIG. 2 that the slot rows 16.*m* and 16.*n* are closer to one another than the remaining ones of the slot rows 16.1 to 16.*m*. When the difference amounts substantially to the width of the aforementioned rim 22*a* to 22*d* and 25*a* to 25*d*, then all of the support elements 12.1 to 12.*n*** appear to be equidistant, which is a desired effect.

It will be understood that each of the elements described above, or two or more together, may also find a useful application in other types of constructions differing from the type described above.

While the present invention has been described and illustrated herein as embodied in a specific construction of an externally shelved display stand, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A display stand comprising:

a) a central column of a tubular configuration that assumes an upright orientation in a use condition of the display stand and includes a number of vertically spaced slot rows each including a plurality of discrete, circumferentially distributed slots; and b) a corresponding number of support elements of shelf-like configurations separate from said central column, including respective mounting portions extending through said slots of the respectively associated ones of said slot rows into the interior of said tubular central column, and extending substantially horizontally in said use condition.

2. The display stand as defined in claim 1, wherein said tubular central column as well as each of said support elements extends along a substantially rectangular course and includes respective corners; wherein said slots of all of said slot rows extend across said corners of said central column; and wherein said mounting portions span said corners of said support elements.

3. The display stand as defined in claim 2, wherein said mounting portions have lobate configurations.

4. The display stand as defined in claim 2, wherein said central column and each of said support elements has a multitude of sides meeting at the respective corners; and wherein each of said support elements has two of said mounting portions located at respective ends thereof, with the neighboring mounting portions of the respective adjacent ones of said sides jointly extending through the respective ones of said slots in a juxtaposed relationship with respect to one another.

5. The display stand as defined in claim 2, wherein each of said sides of each of said support elements has additional portions hingedly connected to said mounting portion and to one another and folded together in said use condition in such a manner as to form an item-retaining rim on the respective support element.

6. The display stand as defined in claim 5, wherein the lowermost one of said support elements as considered in said use condition is inverted relative to the remaining ones of said support elements such that said rim thereof extends downwardly into contact with the ground to provide an extended base for the display stand.

7. The display stand as defined in claim 1, wherein said central column and each of said support elements are constituted of a corrugated board material.

8. The display stand as defined in claim 1, wherein said central column and each of said support elements are each made of a single, generally flat, piece of sheet material.

9. The display stand as defined in claim 1, wherein each of said support elements extends circumferentially around said central column.

* * * * *